US009255738B2

(12) United States Patent
Gartz et al.

(10) Patent No.: US 9,255,738 B2
(45) Date of Patent: Feb. 9, 2016

(54) METHOD AND APPARATUS FOR HEATING A SHEET-LIKE PRODUCT

(75) Inventors: Mats Gartz, Upplands Väsby (SE); Sten Ljungars, Torshälla (SE)

(73) Assignee: AGA AB, Lindingo (SE)

( * ) Notice: Subject to any disclaimer, the term of this patent is extended or adjusted under 35 U.S.C. 154(b) by 1731 days.

(21) Appl. No.: 11/372,677

(22) Filed: Mar. 10, 2006

(65) Prior Publication Data

US 2007/0160948 A1 Jul. 12, 2007

(30) Foreign Application Priority Data

Dec. 27, 2005 (SE) ..... 0502913-7

(51) Int. Cl.

| | |
|---|---|
| ***F27B 9/00*** | (2006.01) |
| ***F27D 99/00*** | (2010.01) |
| ***C21D 1/52*** | (2006.01) |
| ***C21D 9/46*** | (2006.01) |
| ***F27B 9/36*** | (2006.01) |
| ***F27B 9/40*** | (2006.01) |
| ***F27D 19/00*** | (2006.01) |
| ***F27D 21/00*** | (2006.01) |
| *C21D 11/00* | (2006.01) |

(52) U.S. Cl.

CPC ..... *F27D 99/0033* (2013.01); *C21D 1/52* (2013.01); *C21D 9/46* (2013.01); *F27B 9/36* (2013.01); *F27B 9/40* (2013.01); *F27D 19/00* (2013.01); *F27D 21/00* (2013.01); *C21D 11/00* (2013.01)

(58) Field of Classification Search

CPC ..... C21D 1/52
USPC ..... 148/642; 418/642
See application file for complete search history.

(56) References Cited

U.S. PATENT DOCUMENTS

| | | | | |
|---|---|---|---|---|
| 3,291,465 | A * | 12/1966 | Wilde | 432/146 |
| 4,260,362 | A * | 4/1981 | Matthews | 431/69 |
| 5,364,080 | A * | 11/1994 | Kraemer et al. | 266/262 |
| 2001/0036611 | A1* | 11/2001 | Satchell et al. | 432/19 |
| 2004/0112485 | A1* | 6/2004 | Reinhold et al. | 148/639 |

FOREIGN PATENT DOCUMENTS

WO WO03/070992 * 8/2003

* cited by examiner

*Primary Examiner* — Jessee Roe
*Assistant Examiner* — Christopher Kessler
(74) *Attorney, Agent, or Firm* — Alfred J. Mangels

(57) ABSTRACT

A method and apparatus for heating a sheet-like material to a predetermined temperature profile along the length and across the width of the material. The sheet-like material is transported within a furnace relative to at least one burner holder above or below, or above and below, the material. Each burner holder includes a number of direct flame impingement burners located side-by-side in a row. The burners are directed toward the sheet-like material, and the individual burners in each burner holder are oriented and controlled so that heat output from the burners provides the predetermined temperature profile within the sheet-like material.

12 Claims, 4 Drawing Sheets

METHOD AND APPARATUS FOR HEATING A SHEET-LIKE PRODUCT

BACKGROUND OF THE INVENTION

1. Field of the Invention

The present invention relates to a method and apparatus for heating a sheet-like material to a predetermined temperature profile. Such a method is used, for example, in annealing processes prior to forming sheets and plates of metal materials, as well as in furnaces for continuous heat treatment of sheet metals.

2. Description of the Related Art

When heat treating sheets, plates, etc., of a metal material such as steel, it is often desired to be able to control the material characteristics across the heat treated material.

The characteristics can include, by way of example, material hardness, flatness, and residual stress.

An example of such a heat treatment process is when annealing sheets of metal in a furnace prior to forming. In that case, material characteristics that are uniform across the metal sheet are often desired, both in the longitudinal as well as in the transverse directions with respect to the direction of material flow in the heat treatment process, because that provides good formability behavior of the metal sheet in many applications. In order to obtain such uniform material characteristics, it is necessary for the heat transfer to the metal sheet to be uniform across the sheet, in order to obtain a uniform temperature distribution or temperature profile across the entire sheet.

In other applications, a non-uniform, predetermined temperature profile is desired. For example, different hardness characteristics can be wanted on the edges of a metal sheet than at its center, for further processing into a product such as a car roof or the like.

Today, the heat treatment of sheet-like metals usually takes place in a furnace. Commonly used furnaces include fuel-based furnaces that can have an open flame or a heating tube for transferring heat to the metal sheet.

When using such furnaces for the heat treatment of, for example, a metal sheet, it is often not possible to obtain the desired temperature profile across the sheet. Instead, a number of problems occur.

Firstly, prior art furnaces for heat treatment of sheet-like metal materials experience problems with overheated edges, as compared to the heating of the mid-sections of the sheets. The reason for that is that toward the edge of the sheet, the surface area/volume ratio of the sheet increases, which gives rise to faster heat transfer into the metal at the edges. That is common when heat treating sheet or plate products with thicknesses ranging from 1 mm to 100 mm, but is also an issue for materials with an even larger thickness (for example up to 300 mm), and across the whole range of metal materials, including carbon steel, stainless steel, mild steels, aluminum, copper, etc. The temperature difference between the edge and the center of the sheet can be as much as 20° C.

In the case when heat treating metal sheets one by one, the problem arises both at the side edges of the sheet, as well as at the starting and the ending edges. For continuous processing of a long metal sheet, the problem arises mainly at the side edges, but possibly also when starting or stopping the process, or when changing sheets.

The result of that problem is that the transverse and longitudinal temperature differences lead to deformations, uneven hardness, and/or other material characteristics that are non-uniformly distributed across the sheet. In some cases, sheets have to be straightened prior to the next processing step, further deteriorating the hardness and residual stress characteristics of the material. Of course, the problem occurs both in the longitudinal as well as in the transverse direction across the sheet.

Secondly, it is difficult to precisely control the temperature profile, in any direction, across sheet-like metals when using conventional furnaces. As described above, a specific, non-uniform temperature profile might be desired in order to render the heat treated metal suitable for further processing in various applications. Control over the temperature profile is often desired both in the longitudinal and in the transverse directions of the sheet.

Thirdly, in some applications it is desired that some sections of the sheet-like metal are heat treated at different times from other sections. For example, when annealing a metal sheet, the inventors have shown it to be advantageous to heat the mid-section of the sheet first, in order to introduce compressive stress in the mid-section. Thereafter, it is advantageous to transfer heat to the edge of the sheet. That way, the compressive stress introduced in the edges of the sheet will not cause the sheet to deform when the sheet is annealed. That will be described in greater detail below.

The present invention solves the above-described problems.

SUMMARY OF THE INVENTION

Thus, the present invention relates to a method for heating a sheet-like material in an industrial furnace to a predetermined temperature profile along the length of and transversely of the material. The sheet-like material is transported in a furnace relative to at least one holder below the material, and/or at least one holder above the material, each of the holders including a number of DFI (Direct Flame Impingement) burners located in a row beside each other. The DFI burners are directed toward the sheet-like material, and the individual burners in each holder are controlled to give a predetermined heat output.

The invention also relates to an apparatus for carrying out the method.

BRIEF DESCRIPTION OF THE DRAWINGS

The structure, operation, and advantages of the present invention will become further apparent upon consideration of the following description, taken in conjunction with the accompanying drawings in which.

DESCRIPTION OF THE PREFERRED EMBODIMENTS

Figure 1:
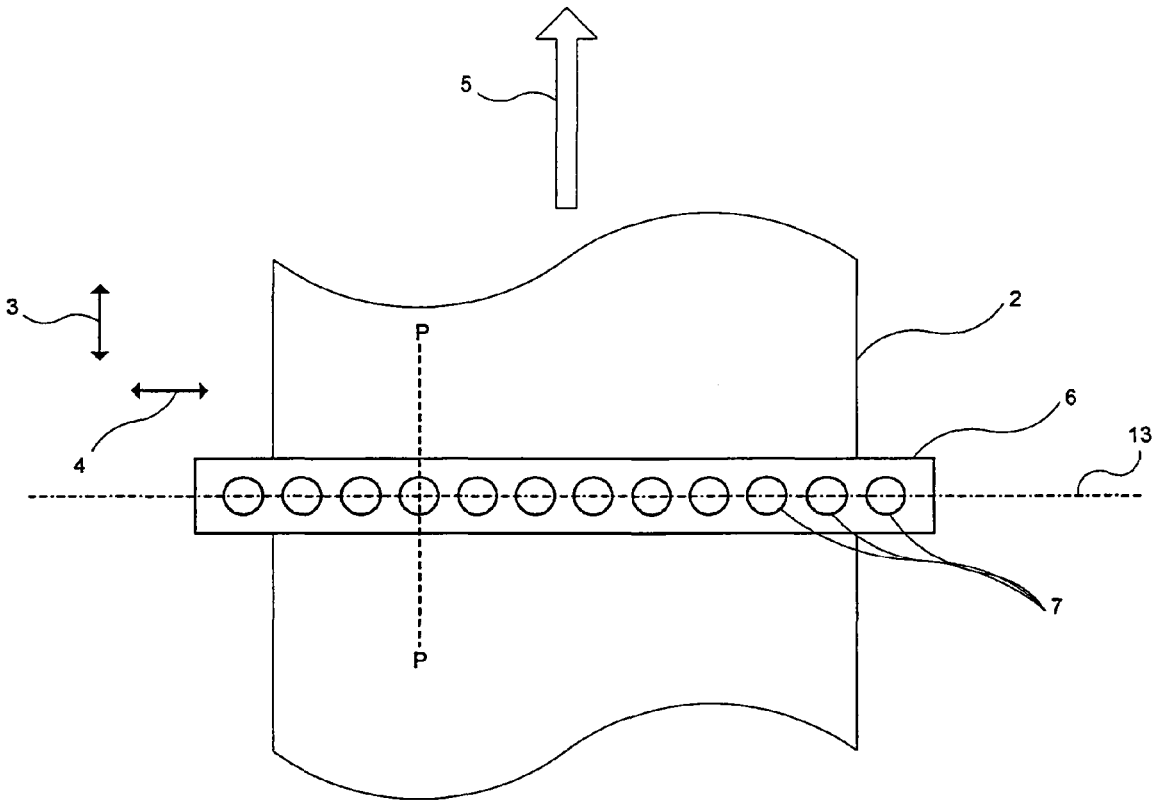
FIG. 1 is a top view of a burner holder in accordance with a first preferred embodiment of the invention and an adjacent metal sheet.
Figure 2:
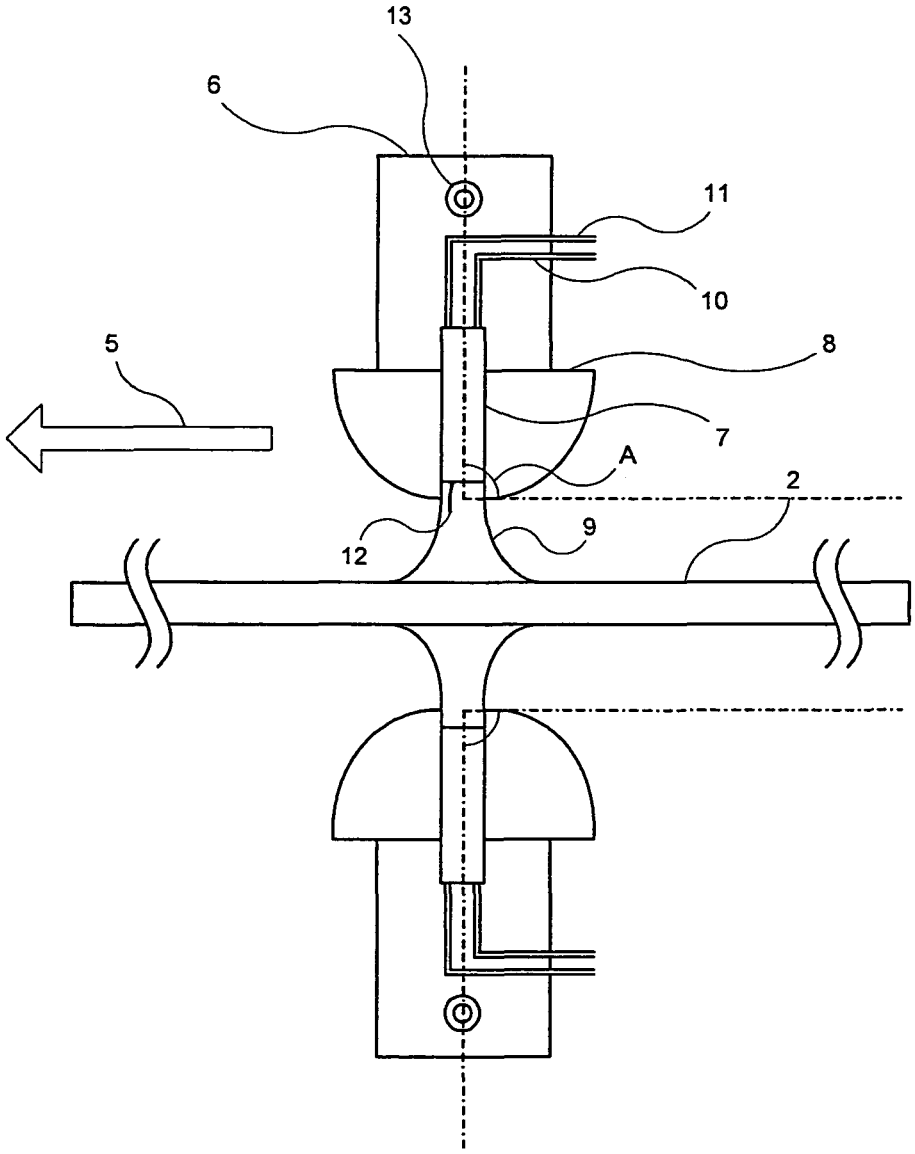
FIG. 2 is a side sectional view of a sheet-like product being heat treated by two individual burners in accordance with a first preferred embodiment the invention.
Figure 3:
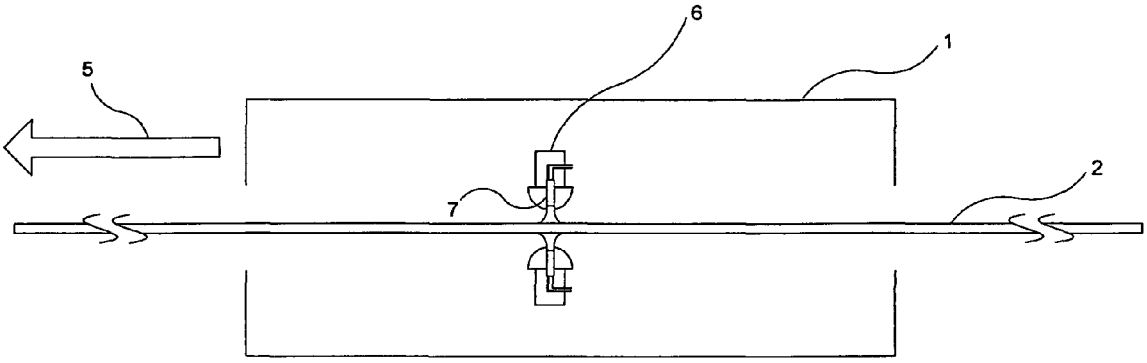
FIG. 3 is a side view of a furnace with a burner holder in accordance with the present invention.

With reference to FIG. 1 through FIG. 3, a first preferred embodiment will now be described.

In the first embodiment, a sheet-like metal is annealed prior to a forming processing step. The material is either preheated, or is heated up to its final forming temperature. In the first case, it is further heated in a secondary furnace up to its final forming temperature.

FIG. 1 shows a metal sheet 2 in a continuous annealing processing step. Associated with the metal sheet 2 are longitudinal and transverse directions indicated by double-headed arrows 3, 4, respectively, relative to the direction of motion 5 of the metal sheet 2. Across the transverse direction 4 of the metal sheet 2, a burner holder 6 is positioned. The holder 6 is provided with a number of individual DFI burners 7, equidistantly spaced along the transverse direction 4 of the metal sheet 2.

FIG. 2 shows a side sectional view in the plane P-P of FIG. 1, of two individual burners 7, positioned on two holders 6, one above the metal sheet 2, and one below the metal sheet. Since the two individual burners 7 are essentially similar, reference numerals are only shown for the upper burner 7. As can be seen, the burners are disposed in a burner retainer 8, allowing the burner to be tilted in order to adjust the tilt angle A of the flame 9 produced by the burner 7, relative to the direction of sheet movement 5. In the present embodiment, the burner angle A can only be adjusted in the longitudinal direction 3 of the metal sheet 2, but it should be noted that any other direction of angular adjustment can also be employed, depending upon the object of the embodiment. Each burner 7 is further equipped with a fuel conduit 10, an oxidant conduit 11, and a nozzle 12. Fuel and oxidant flow control valves (not shown) are used to control the heat output of each individual burner 7.

Such control of the burners can be in the form of switching a burner 7 on or off, either permanently or using a certain update frequency, whereby the burner 7 is switched on and off repeatedly. The burner control can also be in the form of adjusting the heat output of the burner 7 on a continuous scale, to be a percentage of the maximum heat output of the burner 7.

FIG. 3 shows a furnace 1, in which the continuous processing step for heat treating the metal sheet 2 of FIG. 2 takes place. As is the case in FIG. 2, only the reference numerals for the holder 6 and individual burners 7 positioned above the metal sheet 2 are shown, for reasons of symmetry and simplicity.

The burners 7 are fed with a gaseous or liquid fuel, and an oxidant containing at least 80% oxygen.

In the present embodiment, the burners 7 are arranged with respect to their spacing relative to each other and with respect to the distance between the burner nozzles 12 and the surface of the metal sheet 2. The arrangement is such that portions of the flames 9 of adjacent burners 7 that impinge upon the surface of the metal sheet 2 overlap to a certain degree. A typical spacing between successive burners 7 is about 50 mm, and the distance between each burner nozzle 12 and the sheet surface ranges from 50 to 300 mm. However, it is clear that other settings for spacing distance can be used, still achieving the objective of the present invention.

In FIG. 1, only one holder 6 is shown, positioned at one side of the metal sheet. In FIG. 2, two holders 6 are shown, where one holder 6 is positioned on each side of the metal sheet 2. However, it should be understood that several holders can be used in conjunction with each other when heat treating sheet-like metals using the present invention. For example, several holders spaced from each other in the longitudinal direction 3 of material motion 5 can be used to heat the metal 2 in successive steps. It is also possible to treat the material 2 with heat in several successive steps by going over the sheet-like metal 2 several times, using the same holder or holders.

The thickness of the metal sheet 2 can vary between 1 mm and 100 mm, but sheets as thick as 300 mm can be heat treated in certain applications. As a rule, if the metal sheet 2 is up to 2 mm thick, it is possible to feasibly heat the metal sheet 2 using burner holders 6 on only one side of the metal sheet 2. However, if the thickness of the metal sheet 2 is more than 2 mm, it is preferred to use burner holders 6 on both sides of the metal sheet 2, in order for the heat to spread more evenly within the material.

Since the heat output of each DFI burner 7 can be controlled individually, the heat output profile of the heat treatment of the sheet-like metal can be controlled precisely. Thus, the temperature profile, and, consequently, the distribution of material characteristics across the width of the metal sheet after the annealing, such as hardness, flatness, and residual stress, can be controlled.

In order to control the material characteristics in the transverse direction 4, the effective width of the holder 6 as a whole can be altered (by permanently switching on and off individual burners 7), or the intensity of heat output of each individual burner 7 can be controlled.

The present invention can be used for heat treatment of both finite elements of metal sheet, having a well-defined beginning and a well-defined ending, as well as for semi-continuous or continuous processing of an extended metal sheet. Therefore, the same problems can occur near the starting and ending edges of the metal sheet, as can occur on the side edges. Thus, it is an object of the present invention also to provide a way to overcome those problems for all edges of a metal sheet of limited length when processing such sheets.

Thus, in order to control the material characteristics profile in the longitudinal direction 3, the heat delivered by the individual burners 7 can be controlled in real-time, as the metal sheet 2 moves past the holder 6, so that their respective heat outputs are changed when near, or on, the starting or ending edge of the metal sheet 2.

As already noted above, each individual burner 7 can be tilted, so that the angle A of the burner 7 is more or less than 90° with respect to the longitudinal direction 3 of the metal sheet 2. Also, the holder 6 itself, containing the individual burners 7, can be tilted along its longitudinal axis 13, giving rise to an individual, superimposed tilt angle A of each individual burner 7 in the longitudinal direction 3 of the metal sheet 2. The burner tilt angles A are adjusted, for example, for the purpose of controlling the direction of the exhaust fumes; for minimizing the occurrence of leakage air flow; or for controlling the burn-off of contaminant material, such as oils present on the surface of the metal sheet from previous processing steps. The individual burner tilt angle A can be controlled over an angular range of at least 0° to 20° in either direction from the 90° position. Thus, each individual burner tilt angle A can be adjusted in such a way as to control the flames 9 to be directed both toward and away from the direction of motion 5 of the metal sheet 2.

Preferably, there is a feedback system (not shown) for controlling the intensity of the heat delivered by the burners 7 to fit the application at hand. Thus, sensors can be arranged in the furnace 1, on or near the holder 6 and/or the metal sheet 2, to measure the temperature of the metal sheet 2, or to sense any other suitable variable. Based upon those measurements the heat outputs of the individual burners 7 are adjusted, either during continuous operation or between individual sheets when operating the present invention with discrete sheets of metal, so as to optimize the performance of the heat treatment. In that case, the heat output pattern to use can also be fine-tuned in order to suit the characteristics of the actually treated metal sheet.

In the embodiment shown in FIG. 1, the control of the heat outputs of the individual burners 7 is directed toward creating a uniform temperature profile across the transverse direction 4 and along the longitudinal direction 3 of the metal sheet 2. It is envisaged that, in practical applications, the temperature difference between any two points in the metal sheet 2 can be controlled to be less than 1° C. However, it should be noted that any suitable temperature profile, apart from a uniform profile, can be obtained across or along the metal sheet 2 using the present invention.

Figure 4:
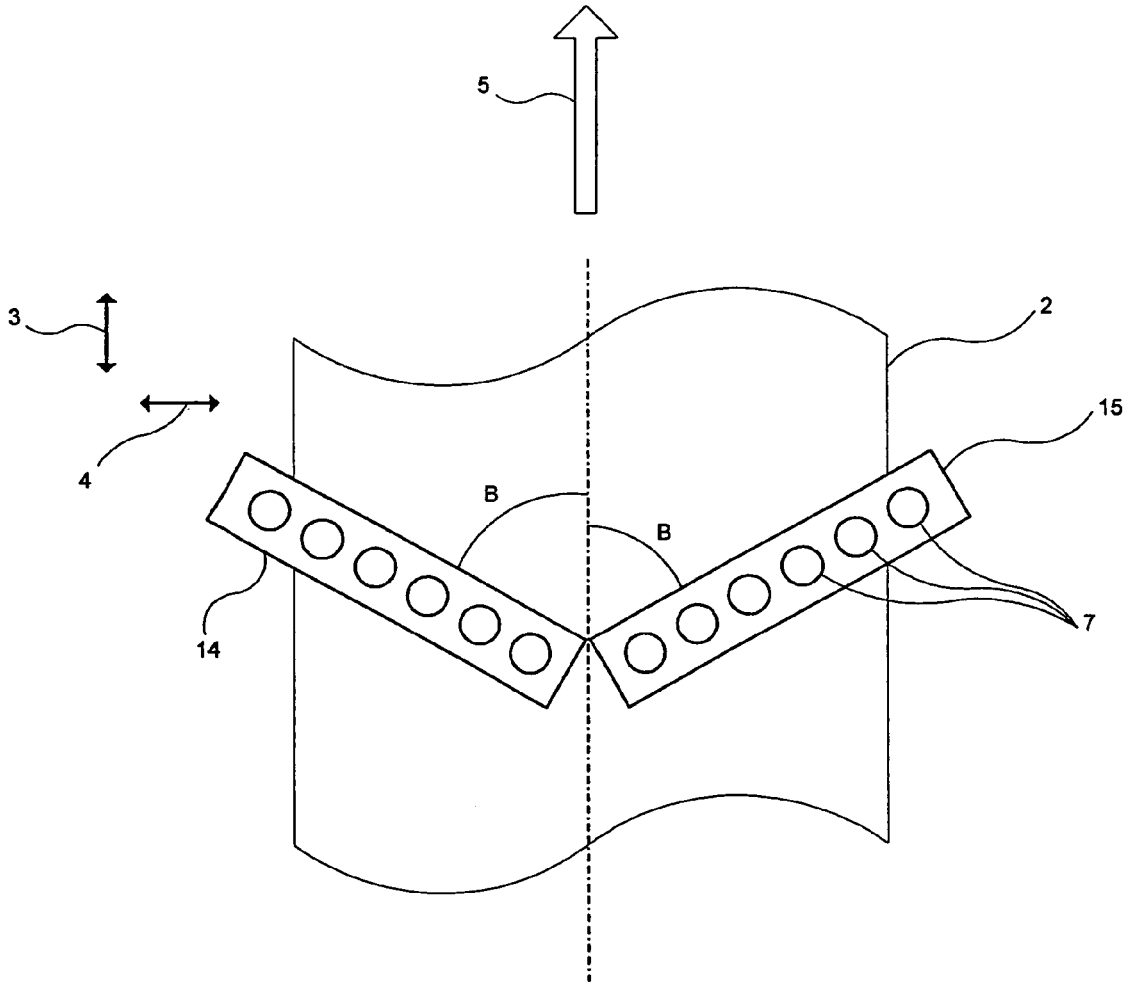
FIG. 4 is a top view of a burner holder array in accordance with a second preferred embodiment of the invention.

Turning to FIG. 4, a second preferred embodiment of the present invention will now be described. The second embodiment is essentially a variation of the first embodiment, and reference numerals for corresponding parts are shared, between FIG. 1 and FIG. 3. Also, the detailed description of some parts of the embodiment shown in FIG. 4 that are common to the several embodiments and already described in detail above is omitted for reasons of simplicity.

In the second embodiment, annealing of a metal sheet 2 is carried out using a first burner holder 14 and a second burner holder 15. The two burner holders 14, 15 are positioned in a V-shaped array and at an included angle 2B, where the angle B of the individual holders relative to the direction of motion 5 of the metal sheet 2 is less than 90°. The V-shaped array extends across the width of the metal sheet 2, and the apex of the V lies substantially at the longitudinal centerline of the metal sheet 2, with the apex of the V pointing in a direction opposite to the sheet movement direction.

Because of the direction of motion 5 of the metal sheet 2 and the angular orientation of holders 14, 15, the central section of the metal sheet 2 is contacted by burner flames 9 before the side sections are contacted. Thus, for a given transverse cross section of the metal sheet 2, the central section is heated before the side sections. Consequently, compressive stresses will be introduced in the central section of the metal sheet 2 as the annealing process continues across the transverse direction 4 of the metal sheet 2. That minimizes the risk of deformation during annealing, since such deformation is otherwise common due to excessive compressive stress in the side sections of annealed metal sheets, as compared to their central sections.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A method for heating a moving metallic sheet material within an industrial furnace to a predetermined temperature profile to control post-heating physical characteristics of the sheet material in transverse and longitudinal directions of the sheet, said method comprising the steps of:

establishing a predetermined, non-uniform transverse temperature profile within the sheet material for providing a predetermined transverse physical characteristic of the heated sheet material, wherein the sheet material has an upper surface and a lower surface;

establishing a predetermined longitudinal temperature profile within the sheet material for providing a predetermined longitudinal physical characteristic of the heated sheet material;

providing within the furnace at least one burner holder spaced from inner upper and inner lower surfaces of the furnace and including a plurality of individually controlled direct flame impingement burners arranged in side-by-side relationship in a transverse direction relative to a sheet material movement direction within the furnace, wherein the burner holder includes a longitudinal axis that extends in the transverse direction relative to the sheet material movement direction, wherein the burners each include a longitudinal central axis and a burner nozzle having an outlet that faces and is spaced from at least one of the upper and lower surfaces of the sheet material at a distance of between 50 and 300 mm, wherein the longitudinal central axes of respective burners when extended beyond a burner nozzle outlet intersect respective spaced regions of the at least one of the upper and lower surfaces of the sheet material, and wherein the longitudinal central axes of the burners each lie in a plane that extends transversely to the sheet material movement direction;

feeding to each burner a fuel and an oxidant containing more than 80% by weight of oxygen;

transporting the sheet material within the furnace in the sheet material movement direction;

orienting the at least one burner holder so that the burner longitudinal central axes are directed toward the at least one of the upper and lower surfaces of the sheet material as the sheet material is transported through the furnace, so that flames issuing from the burner nozzles impinge upon the at least one of the upper and lower surfaces of the sheet material, and wherein each burner longitudinal central axis is perpendicular to the at least one of the upper and lower surfaces of the sheet material when viewed in the sheet material movement direction;

positioning the burners relative to their side-by-side arrangement and relative to a spacing between respective burner outlet nozzles and the at least one of the upper and lower surfaces of the sheet material, so that flames issuing from adjacent burners overlap each other at the at least one of the upper and lower surfaces of the sheet material; and controlling flow of fuel and oxidant to individual burners as the sheet material moves through the furnace to provide a predetermined burner heat output from respective ones of the burner nozzles to heat the sheet material to the predetermined non-uniform transverse temperature profile and to the predetermined longitudinal temperature profile as the sheet material is transported through the furnace, wherein the predetermined non-uniform transverse temperature profile is produced within the sheet material to provide in the heated sheet material desired non-uniform physical characteristics in the transverse direction of the sheet material, including at least one of material hardness, material flatness, and material residual stress, and wherein the predetermined longitudinal temperature profile is produced in the longitudinal direction within the sheet to provide in the heated sheet desired physical characteristics in the longitudinal direction of the sheet, including at least one of material hardness, material flatness, and material residual stress.

2. A method in accordance with claim 1, including the step of spacing the burner longitudinal central axes from each other at a predetermined spacing along the at least one burner holder.

3. A method in accordance with claim 2, wherein the burners are equidistantly spaced from each other along the at least one burner holder.

4. A method in accordance with claim 1, including the step of tilting the at least one burner holder about its longitudinal axis so that longitudinal axes of individual burners are adjusted to form a tilt angle different from 90° relative to the at least one of the upper and lower surfaces of the sheet material in the sheet material movement direction.

5. A method in accordance with claim 1, including the step of providing a pair of burner holders disposed in a V-shape adjacent to at least one of the upper and lower surfaces of the sheet material, and adjusting each of the burner holders to form an angle of less than 90° relative to the sheet material movement direction.

6. A method in accordance with claim 5, wherein the V-shape of the burner holders includes an apex, and the apex of the V-shape lies substantially at a longitudinal centerline of the sheet material.

7. A method in accordance with claim 6, wherein the apex of the V-shape of the burner holders points in a direction opposite to the sheet material movement direction.

8. A method in accordance with claim 1, including the step of controlling heat output from each individual burner to provide intermittent heat output from each individual burner by switching individual burners on and off in a predetermined manner to achieve in the sheet material the predetermined non-uniform transverse temperature profile and the predetermined longitudinal temperature profile.

9. A method in accordance with claim 1, including the step of controlling heat output from each individual burner to provide continuous heat output from each individual burner.

10. A method in accordance with claim 1, including the step of orienting the burners so that the longitudinal central axes of each of the burners within the at least one burner holder are parallel to each other.

11. A method in accordance with claim 1, including the steps of:

establishing a predetermined, non-uniform longitudinal temperature profile for providing predetermined longitudinal physical characteristics within the heated sheet material; and controlling flow of fuel and oxidant to individual burners as the sheet material moves through the furnace to provide from respective burners a predetermined heat output to heat the sheet material to the predetermined non-uniform longitudinal temperature profile, wherein a non-uniform temperature profile is produced in the longitudinal direction within the sheet material to provide within the heated sheet material desired non-uniform physical characteristics in the longitudinal direction of the sheet material, including at least one of material hardness, material flatness, and material residual stress.

12. A method in accordance with claim 1, wherein the longitudinal central axes of the burners each lie on a single line that extends transversely relative to the sheet movement direction.

* * * * *